United States Patent [19]

Nakamura et al.

[11] Patent Number: 5,049,915

[45] Date of Patent: Sep. 17, 1991

[54] PHOTOSENSITIVE MATERIAL PROCESSING APPARATUS WITH DRYER

[75] Inventors: Takashi Nakamura, Minami-ashigara; Kiyotaka Hori, Hatano; Kaoru Uchiyama, Minami-ashigara, all of Japan

[73] Assignee: Fuji Photo Film Co., Ltd., Kanagawa, Japan

[21] Appl. No.: 508,671

[22] Filed: Apr. 13, 1990

[30] Foreign Application Priority Data

Apr. 14, 1989 [JP] Japan ..... 1-94419

[51] Int. Cl.[5] ..... G03D 3/08

[52] U.S. Cl. ..... 354/339; 354/322; 34/155

[58] Field of Search ..... 354/299, 220, 321, 322, 354/297, 339; 34/155, 162

[56] References Cited

U.S. PATENT DOCUMENTS

| | | | |
|---|---|---|---|
| 3,557,752 | 1/1971 | Hakanson | 354/339 X |
| 4,954,838 | 9/1990 | Nakamura et al. | 354/320 |
| 4,980,714 | 12/1990 | Nakamura et al. | 354/322 |

*Primary Examiner*—A. A. Mathews

*Attorney, Agent, or Firm*—Sughrue, Mion, Zinn Macpeak & Seas

[57] ABSTRACT

In photographic silver halide photosensitive material processing apparatus comprising a processing tank for processing the photosensitive material by dipping it in a processing solution and a drying section including pairs of transport and guide rollers for cooperatively transporting the photosensitive material therethrough while drying it, the transport and guide rollers are provided with a coating containing a hydrolytic silicon oxide condensate or a silicone resin.

9 Claims, 2 Drawing Sheets

PHOTOSENSITIVE MATERIAL PROCESSING APPARATUS WITH DRYER

This invention relates to photosensitive material processing apparatus adapted for use as silver salt photographic copying machines and automatic processors.

BACKGROUND OF THE INVENTION

The silver salt photographic copying machine is adapted to duplicate a document image on a sheet of photosensitive material and is advantageous over conventional electrophotographic copying machines in that images of higher quality can be duplicated. In general, the silver salt photographic copying machine includes photosensitive material supply, exposure, processing, and drying sections A strip of photosensitive material is fed from a magazine in the photosensitive material supply to the exposure section where it is exposed to a document image, then to the processing section where it is wet processed for development, and finally to the drying section where it is dried, obtaining a duplicated picture. More particularly, the processing section includes a series of tanks for development, bleachfixation, and washing The exposed photosensitive material is passed through the tanks which are filled with respective processing solutions. Thereafter, the photosensitive material is dried in the drying section, completing image In this type of photosensitive material processing apparatus, the drying section is usually maintained at temperatures of about 60° C. to about 90° C. The drying section has transport rollers with which the photosensitive material passes through the drying section in about 10 to about 60 seconds. Each transport roller used in the drying section is most often an assembly of axially spaced-apart cylindrical segments mounted on a shaft, which is referred to as a discontinuous roller, hereinafter. The discontinuous rollers permit the photosensitive material to move straight forward during transportation and prevent oblique travel, winding, twisting and wrinkling, thus minimizing jam. Most often, the transport rollers are formed of a relatively hard material such as vinyl chloride resin, phenol resin, and high molecular weight polyethylene. Unfortunately, it has been found that transport rollers of conventional hard material can cause flaws, scratches and marks on pictures especially in a low humidity environment or in winter.

SUMMARY OF THE INVENTION

An object of the present invention is to provide a photosensitive material processing apparatus having an improved drying section which allows efficient transport of photosensitive material without causing mars, scratches and drying marks.

Briefly stated, the present invention pertains to an apparatus for processing photographic silver halide photosensitive material having an emulsion layer, comprising a processing section for wet processing the photosensitive material and a drying section for drying the processed photosensitive material. The drying section includes a region which comes in contact with the emulsion surface of the photosensitive material The contact region is at least partially provided with a coating containing a hydrolytic silicon oxide condensate or a silicone resin. Most preferably, the contact region is substantially entirely provided with such a coating.

Most often, the drying section includes at least one roller for transporting the photosensitive material, which has the coating on its surface. The drying section may further include at least one guide member for assisting the transportation of the photosensitive material, which has the coating on its surface.

The coating on the contact region in the drying section minimizes scratches, stains, and drying marks on the photosensitive material upon drying. Though not bound to the theory, it is presumed that the coating material used herein has positive electrostatic properties with respect to the gelatin of which the emulsion layer of the photosensitive material is formed and positive electric charges prevent the occurrence of scratches, stains, and drying marks due to dust and debris. The coating itself does not cause any damage to the photosensitive material.

BRIEF DESCRIPTION OF THE DRAWINGS

The above and other objects, features, and advantages of the present invention will be better understood from the following description taken in conjunction with the accompanying drawings, in which.

DESCRIPTION OF THE PREFERRED EMBODIMENTS

Figure 1:
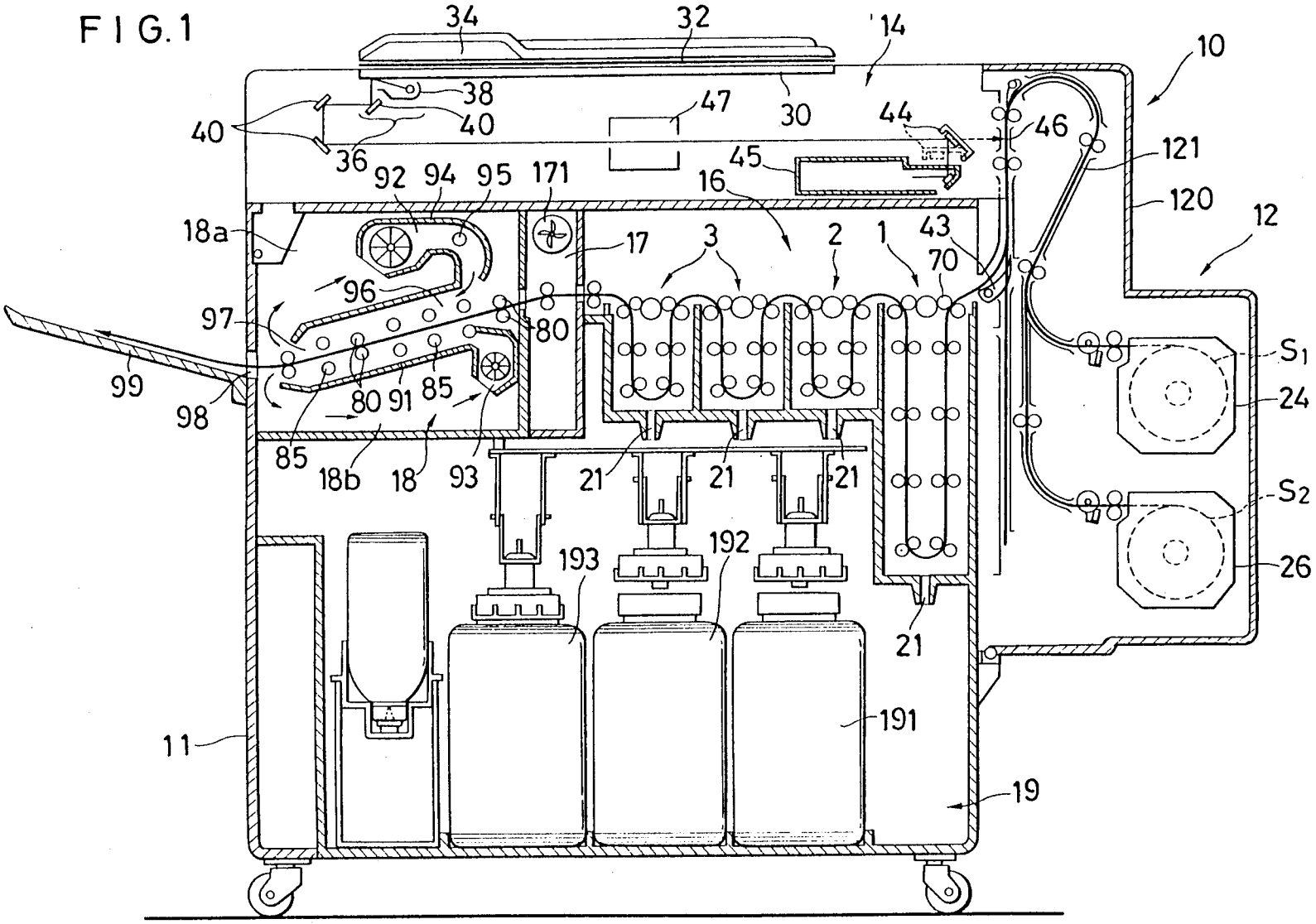
FIG. 1 is a schematic cross-sectional elevation of a copying machine embodying the photosensitive material processing apparatus of the invention.

Referring to FIG. 1, a silver salt photographic color copying machine is illustrated as embodying the photosensitive material processing apparatus of the invention.

The copying machine generally designated at 10 includes a photosensitive material supply section 12 on the right, an exposure section 14 at the top, a processing section 16 below the exposure section, an air chamber 17 and a drying section 18 on the left, and a reservoir section 19 below the processing section 16, all enclosed in a housing 11 as shown in FIG. 1.

The photosensitive material supply section 12 of the copying machine 10 has a casing 120 detachably mounted to the housing 11. The supply section 12 includes a pair of upper and lower magazines 24 and 26 housed in the casing 120 and pairs of rollers arranged so as to define a transport path 121. In the magazines 24 and 26, strips of photosensitive material S1 and S2 which may be the same or different are accommodated in roll form. The leading end of each strip of photosensitive material is extended from the magazine to the transport path 121.

Typical examples of the photosensitive material used herein include (1) ordinary copying photosensitive material (positive), (2) photographic copying photosensitive material (positive), (3) negative print photosensitive material (negative), and (4) overhead projector photosensitive material (positive). The two magazines 24 and 26 may be loaded with any two of these four types (1) to (4) of photosensitive material in the following combinations, for example.

Combination 1: (1)-(2)
Combination 2: (1)-(3)
Combination 3: (1)-(4)
Combination 4: (2)-(3)
Combination 5: (2)-(4)
Combination 6: (3)-(4)

The strip of photosensitive material S1 or S2 taken out of the magazine 24 or 26 (only strip S1 is described hereinafter as a representative) is extended along the transport path 121 in the supply section 12 and moved across an exposure window 46 in the exposure section 14 where it is exposed to an image of a color document 32 on a transparent platen 30 disposed at the top of the exposure section 14.

The exposure section 14 includes the transparent platen 30, a cover 34 pivotally mounted for holding the color document 32 on the platen 30, a light source unit 36 including a light source 38, a plurality of mirrors 40, optical means 47, a shutter 44, and an image sensor 45 arranged in a conventional manner. The exposure section operates such that the color document 32 on the platen 30 is scanned with light from the light source 38. The resulting document image is reflected by the mirrors 40, transmitted by the optical means 47, and directed to the photosensitive strip S1 within the window 46 through the shutter 44 when it is opened. When the shutter 44 is closed, the document image is reflected by an inside mirror of the shutter 44 toward the image sensor 45 for determining an exposure correcting factor, that is, for the pre-scanning purpose.

A changeover guide 43 is pivotally disposed intermediate the transport path 121 for the photosensitive strip S1 and below the exposure window 46 for selectively introducing the photosensitive strip S1, which is otherwise moving vertically downward, into the processing section 16.

The processing section 16 includes a series of processing tanks. A developing tank 1, a bleach-fixing tank 2, and two wash tanks 3 are arranged in side-by-side relation from the right as viewed in FIG. 1. The tanks 1, 2, and 3 are filled with respective processing solutions, that is, a developer, a bleach-fixer, and wash water, respectively. The tanks are provided with means for successively transporting the photosensitive strip S1 therethrough. The transport means are schematically shown by properly arranged rollers 70. The transport means allows the photosensitive strip S1 to be successively dipped in the processing solutions in the respective tanks at appropriate temperatures whereby the strip S1 is developed, bleachfixed, and water washed.

The reservoir section 19 disposed below the processing section 16 has accommodated therein bottles 191, 192, and 193 for storing a developer, a bleach-fixer, and wash water, respectively. The bottles 191, 192, and 193 are connected for fluid communication to bottom inlet ports 21 of the corresponding tanks 1, 2, and 3 through conduits with pumps (not shown). Fresh processing solution or replenisher can be supplied from a selected bottle to the corresponding tank by actuating the corresponding pump.

The air chamber 17 is disposed between the processing and drying sections 16 and 18. The photosensitive strip S1 which has been washed with water in the processing section 16, more exactly, the last wash tank 3, is passed through the air chamber 17 before entry to the drying section 18. The air chamber 17 is located for the purpose of preventing heat conduction from the drying section 18 to the processing section 16 to heat the processing solutions above the appropriate temperatures. A vent fan 171 is installed near the top of the air chamber 17 for venting hot air from the drying section 18 to the exterior.

The drying section 18 includes several (three in the figure) pairs of transport rollers 80 either one or both of which are driven for rotation. The roller pairs are arranged so as to define a substantially straight path along which the photosensitive strip S1 is conveyed forward (to the left in the figure). The path is slant downward in the illustrated embodiment. A duct 91 for drying air is provided so as to surround the transport path for the photosensitive strip S1. The duct 91 defines a start-of-drying zone 96 adjacent its upstream end and an end-of-drying zone 97 adjacent its downstream end. An upper fan 92 having a rotor with radially extending vanes is disposed at the top of the drying section 18 and a discharge port of the fan 92 is connected to a throat 94 which in turn, merges with the upper upstream end of the duct 91. A heater 95 is disposed within the throat 94 for heating the air from the fan 92 to an appropriate temperature, for example, about 50° C. to about 150° C. A lower fan 93 of similar construction is disposed at the right lower end of the drying section 18 and has a discharge port which merges with the lower upstream end of the duct 91.

Air is taken in by the upper fan 92 through its intake port, passed through the throat 94 from the fan discharge port, and heated to an appropriate temperature, for example, about 50° C. to about 150° C., preferably 60° to 90° C., by the heater 95 in the throat 94. This hot air enters the duct 91 or start-of-drying zone 96. Air is also taken in by the lower fun 93 through its intake port and fed through its discharge port into the duct 91 or start-of-drying zone 96. These air streams combine into drying air in the drying start zone 96 and the drying air passes through the duct 91 along the photosensitive strip S1 transport path while removing water from the surface of the photosensitive strip S1. Past the end-of-drying zone 97, the drying air exits from the downstream opening of the duct 91 and diverts into upper and lower streams. The upper and lower streams of drying air are again sucked into the intake ports of the upper and lower fans 92 and 93 through upper and lower spaces 18*a* and 18*b*, respectively. The, drying section 18 is of the recycle design that the drying air which has been used in drying of the photosensitive strip S1 in the duct 91 is fed back to the start-of-drying zone 96.

The photosensitive strip S1 which has been dried in the drying section 18 as described above is delivered on an output tray 99 through a gate 98.

It is to be understood that the photosensitive strip S1 is passed through the drying section 18 with its emulsion layer surface faced vertically upward.

The construction of the transport system used in the drying section of the photosensitive material processing apparatus of the invention is described in detail.

Figure 2:
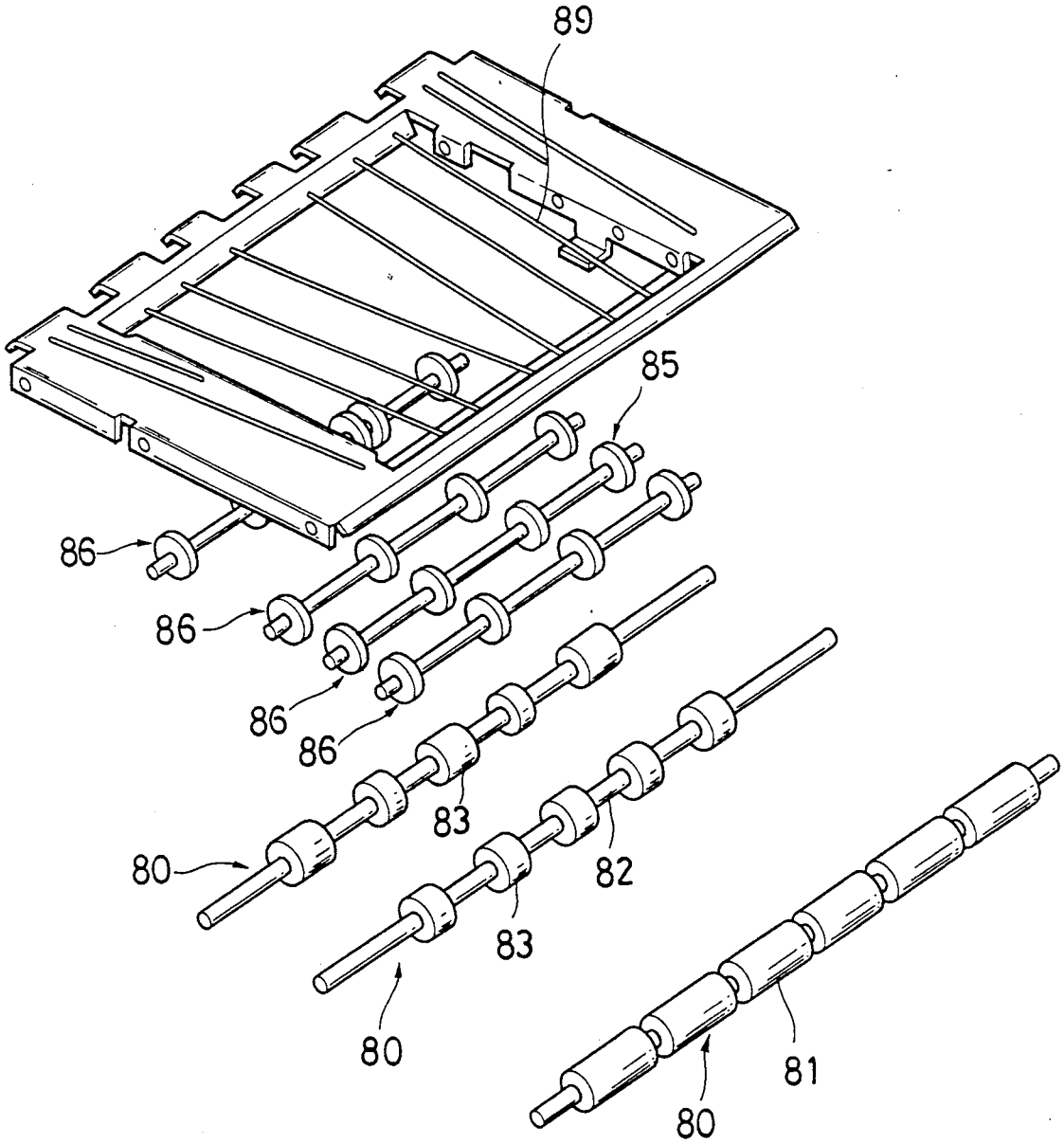
FIG. 2 is a perspective view showing in exploded relationship members of the drying section in the photo sensitive material processing apparatus of the invention.

Referring to FIG. 2, there is illustrated an upper portion of the transport system used in the drying section 18 of the photosensitive material processing apparatus shown in FIG. 1. Those members of the transport system located above the photosensitive strip, more exactly above the emulsion layer surface of the photosensitive strip, are shown in exploded and separately arrayed relation.

In the embodiment illustrated in FIGS. 1 and 2, each of the transport rollers 80 is a discontinuous roller having axially spaced-apart roller segments 81 or 83 mounted on a shaft 82. Although the transport system includes three pairs of transport rollers 80 in the illustrated embodiment, the number of roller pairs may be properly determined depending on the dimensions of the photosensitive strip S1. Also, the dimensions and arrangement of roller segments 81 or 83 may vary with a particular application and be empirically determined. Since the transport rollers 80, 80 of each pair are generally in frictional contact, they can be driven for rotation by driving either one roller by conventional drive means. The roller segments 81 and 83 are substantially the same cylindrical segments except that roller segments 81 are relatively long and roller segments 83 are relatively short in the axial direction.

The paired transport rollers 80, 80 serve to convey the photosensitive strip forward through frictional clamping engagement. The upper transport rollers 80 shown in FIG. 2 come in contact with the emulsion layer surface of the photosensitive strip.

According to the present invention, the rollers are provided with a coating which contains a hydrolytic silicon oxide condensate or a silicone resin.

The hydrolytic silicon oxide condensates used herein include hydrolytic condensates of alkyl silicates such as ethyl silicate and silicon halides. Most often, a coating composition is prepared by blending the silicon alkoxide or halide with a binder and an organic solvent. Examples of the binder include chlorinated rubbers, phenol resins, acrylic resins, epoxy resins, melamine resins, fluoro resins, alkyd resins, urethane resins, modified petroleum resins, polycarbonates, and polyamides. The coating composition is applied by spraying or similar coating techniques and then heated or spontaneously dried to produce a hydrolytic silicon oxide condensate. To this end, a coating composition commercially available under the tradename "Super-Finish" from Irie Kouken K.K. is useful.

The coating is preferably about 2 to about 50 μm thick. It preferably contains at least 10% by weight of silicon oxide. For increased coating strength, the coating consists essentially of about 20 to 40% by weight of silicon oxide and the binder.

The silicone resins used herein include a variety of organopolysiloxane resins, for example, room temperature vulcanizable silicone rubbers or resins, thermosetting silicone rubbers or resins, UV curable silicone rubbers or resins, silicone acryl resins, fluoro resin-modified silicone acryl resins, polydimethylsiloxane-polycarbonate copolymers, and mixtures thereof. The organosiloxanes which form these silicone rubbers or resins include various well-known organosiloxanes and condensates thereof as disclosed in Japanese Patent Application Unexamined Publication (JP-A) Nos. 25868/1984, 45361/1984, and 206888/1985. UV curable organosiloxanes having a vinyl group attached to a silicon atom and condensates thereof may also be used. Photosensitizers are preferably blended in the UV curable organopolysiloxanes.

The silicone resin may be dissolved in a suitable solvent and applied by spraying or similar coating techniques. The coating is preferably about 2 to about 50 μm thick.

Any desired resin may be added to the silicone resin. The additional resins used herein include chlorinated rubbers, phenol resins, acrylic resins, epoxy resins, melamine resins, fluoro resins, alkyd resins, urethane resins, modified petroleum resins, polycarbonates, and polyamides.

The coating preferably contains at least 20% by weight of the silicone resin.

Coating compositions containing such silicone resins are commercially available, for example, as "Bioclean" from Chugoku Paint K.K., "Defro S" and "Excela" from Kansai Paint K.K., "AF Bio-Super II" from Usagida Chemical K.K., coating agents from U.S. Army Corp. of Engineers, "Silicone-Modified Top" from Nihon Fat & Oil K.K., "OPTIGARD X-3-6610" from Dow Corning Corp., "Pitt-Therm" from PPG, and "Kaneka Zemrack" from Kanegafuchi Chemical K.K.

It is also contemplated that the silicone resin is partially replaced by a hydrolytic silicon oxide condensate as defined above. The coating composition for forming the desired coating may further contain a viscosity adjusting agent, surface-active agent, reaction promoter, or the like.

The roller segments 81 or 83 to which the coating is applied is preferably formed of a resinous material, for example, polyvinyl chloride, phenol resin and high molecular weight polyethylene, with the polyvinyl chloride being most preferred. It is to be noted that the drive shaft 82 having the rollers 81 or 83 mounted thereon, which is typically of metal, may be provided with the present coating if desired.

In the embodiment shown in FIGS. 1 and 2, pairs of free guide rollers 85 are arranged along the transport path. The guide rollers of each pair are on the opposite sides of the path and slightly spaced apart therefrom. Each guide roller 85 has a plurality of disks 86 mounted on a metal shaft 87. The disks 86 of the guide rollers 85 are generally formed of a resinous material, for example, polyvinyl chloride, phenol resin and high molecular weight polyethylene. The disks 86 of the guide rollers 85 on the side facing the emulsion layer of the photosensitive strip are preferably provided with the present coating on their outer surface.

In the embodiment shown in FIG. 2, a plurality of metallic guide wires 89 are extended outside the transport and guide rollers 80 and 85 in parallel to the travel direction in order to ensure that a thin sheet of photosensitive paper be transported along the path. Since there is a possibility that the photosensitive strip contact the guide wires 89, those guide wires 89 which face the emulsion layer of the photosensitive strip are preferably provided with the present coating.

By applying the coating to the transport rollers, preferably the transport and guide rollers, more preferably the transport and guide rollers and guide wires, the occurrence of scratches, mars, and drying marks is minimized.

The construction of the photosensitive material processing apparatus, especially the arrangement of transport rollers is not limited to the embodiment shown in FIG. 2. For example, the roller arrangement may be a staggered roller arrangement wherein transport rollers are located alternately along the transport path. Each of the transport rollers used in this arrangement may have the same configuration as previously described. Although the discontinuous rollers have been illustrated, continuous rollers having a continuous cylindrical surface may be used. However, discontinuous rollers are recommended for efficient drying and positive transport abilities.

The type of photosensitive material which can be processed in the apparatus of the invention is not particularly limited. Any desired types of photosensitive material may be processed, including color negative film, color reversal film, color photographic paper, color positive film, color reversal photographic paper, printing photographic photosensitive material, radiographic photosensitive material, black-and-white negative film, black. and-white photographic paper, and micro-film photosensitive material.

The photosensitive material processing apparatus of the invention will find a variety of uses such as wet copying machines, automatic developing machines, printer processors, video printer processors, photographic print producing vending machines, and proof color paper processors.

EXAMPLE

Examples of the present invention are given below by way of illustration and not by way of limitation.

EXAMPLE 1

A positive photosensitive material as defined in Example 1 of U.S. Ser. No. 07/200,268 (JP-A No. 236036/1988). This material was processed for development using an apparatus of the configuration shown in FIG. 1. This apparatus is precisely described in U.S. Ser. No. 07/230,948 (Japanese Patent Application No. 212293/1987). Drying was carried out for 30 seconds at 75° C.

The roller segments 81 and 83 of transport rollers 80, disks 86 of guide rollers 85, and guide wires 89 used in the drying section 18 are shown below.

Transport rollers:
- 3 pairs
- Roller diameter: 20 mm
- Vinyl chloride resin

Guide rollers:
- 4 pairs
- Disk diameter: 20 mm
- Vinyl chloride resin

Guide wires:
- Two sets each consisting of 5 wires
- Wire diameter: 0.8 mm
- Stainless steel These members were provided with the following coatings on their outer surface.

Coating A

Coating A was applied by multi-layer spray coating a coating solution of ethyl silicate and an acrylic resin in acetone solvent, allowing the coating to spontaneously dry, and heating at 100° C. for 30 minutes for forced drying. The coating was 26 μm thick and contained 22% by weight of $SiO_2$.

Coating B

Coating B was applied by adding 1 part by weight of a silicone oil to 2 parts by weight of a polydimethylsiloxane (65 wt %)/bisphenol-A polycarbonate (35 wt %) block copolymer, dissolving the mixture in toluene, and spray coating the 14 μm thick.

Coating C

Coating C was applied by adding an effective amount of a curing catalyst to an acryl silicone oligomer having a siloxane group attached to the acrylic backbone (molecular weight 10,000), dissolving the mixture in toluene, and coating the resulting composition, followed by room temperature curing. The coating was 8 μm thick.

Coating D

Coating D was applied by adding an acetal resin to 30% by weight of room temperature-curable polydimethylsiloxane (silicone rubber), dissolving the mixture in methyl ethyl ketone, and coating the resulting composition. The coating was 12 μm thick.

Coating E

Coating E was applied by adding 2% by weight of a phenolic resin to a silicone acryl resin, dissolving the mixture in amyl alcohol, and spray coating the resulting composition. The coating was 18 μm thick.

Coating F

Coating F was applied by dissolving a silicone rubber in chloroform, and coating the resulting composition. The coating was 33 μm thick.

Coatings G and H are outside the scope of the invention.

Coating G

Coating G was applied by coating a 10% toluene solution of Teflon, followed by drying. The coating was 18 μm thick.

Coating H

Coating H was applied by coating a 6% benzyl alcohol solution of polyethylene, followed by drying. The coating was 12 μm thick.

The processing apparatus was equipped with the drying section having the transport and guide rollers covered with each of the above-mentioned coatings and installed in a metropolitan office building where air was relatively contaminated. The apparatus was turned on for 10 hours per day and four A-4 size sheets of photosensitive material were processed a day. The following properties were evaluated.

(1) Scratches upon drying

After a sheet of photosensitive material was exposed and processed in the apparatus so as to be black over the entire area, it was then visually inspected at angle of 45°under lamps of 100 lux and 1,000 lux.

Pass: no scratch

Fair: no apparent scratch under 100 lux, but scratches perceivable under 1,000 lux Fail: apparent scratches under 100 lux

(2) Drying marks

A running test was conducted over one month, and 100 sample sheets were visually inspected for drying marks under lamps of 100 lux and 1,000 lux.

Pass: no mark

Fair: no apparent mark under 100 lux, but marks perceivable under 1,000 lux

Fail: apparent marks under 100 lux

The results are shown in Table 1.

TABLE 1

| Coating | Drying marks | Scratches upon drying |
|---|---|---|
| A | Pass | Pass |
| B | Pass | Pass |
| C | Pass | Pass |
| D | Pass | Pass |
| E | Pass | Pass |
| F | Pass | Pass |
| G | Fail | Pass |
| H | Fail | Pass |
| No coating | Pass | Fail |

Coatings G and H are comparative coatings outside the scope of the invention.

As seen from Table 1, scratches and drying marks are minimized by covering the rollers with the present coating. It was also found that the rollers with coatings A to F were excellent in conveying sheets of photosensitive material straight forward. In another run at a drying temperature of 90° C., no problem was found over 336 hours of operation.

By applying a coating containing a hydrolytic silicon oxide condensate or a silicone resin to at least a portion of the contact region of the drying section which comes in contact with the emulsion surface of a photosensitive material, typically transport and guide rollers, the drying section is successful in efficiently transporting the photosensitive material while minimizing the occurrence of drying marks and flaws on the photosensitive material.

Although some preferred embodiments have been described, many modifications and variations may be made thereto in the light of the above teachings. It is therefore to be understood that within the scope of the appended claims, the invention may be practiced otherwise than as specifically described.

We claim:

1. In apparatus for processing photographic silver halide photosensitive material having an emulsion layer, comprising a processing section for wet processing the photosensitive material and a drying section for drying the processed photosensitive material, said drying section including a region which comes in contact with the emulsion surface of the photosensitive material, the improvement wherein said contact region is at least partially provided with a coating containing a hydrolytic silicon oxide condensate or a silicone resin.

2. The apparatus of claim 1 wherein said contact region is substantially entirely provided with the coating.

3. The apparatus of claim 1 wherein said coating has a thickness of 2 to 50 μm.

4. The apparatus of claim 1 wherein said coating contains at least 10% by weight of silicon oxide.

5. The apparatus of claim 4 wherein said coating contains 20 to 40% by weight of silicon oxide and a resinous binder.

6. The apparatus of claim 1 wherein said coating contains at least 20% by weight of the silicone resin.

7. The apparatus of claim 1 wherein said drying section includes at least one member disposed so as to contact the emulsion surface of the photosensitive material for transporting the photosensitive material and said member has the coating on its surface.

8. The apparatus of claim 1 wherein said drying section includes at least one roller for transporting the photosensitive material and said transport roller has the coating on its surface.

9. The apparatus of claim 8 wherein said drying section further includes at least one guide member for assisting the transportation of the photosensitive material and said guide member has the coating on its surface.

* * * * *